US007755299B2

(12) United States Patent
Weger

(10) Patent No.: US 7,755,299 B2
(45) Date of Patent: Jul. 13, 2010

(54) TRANSFORMER FOR BALANCING CURRENTS

(75) Inventor: Robert Weger, Wels (AT)

(73) Assignee: Minebea Co., Ltd., Nagano-ken (JP)

( * ) Notice: Subject to any disclaimer, the term of this patent is extended or adjusted under 35 U.S.C. 154(b) by 500 days.

(21) Appl. No.: 11/893,541

(22) Filed: Aug. 15, 2007

(65) Prior Publication Data

US 2008/0048495 A1 Feb. 28, 2008

(30) Foreign Application Priority Data

Aug. 25, 2006 (DE) ..... 10 2006 040 026

(51) Int. Cl.
*H05B 41/16* (2006.01)

(52) U.S. Cl. ..... 315/279; 315/282; 315/283; 315/324; 323/355; 323/356

(58) Field of Classification Search ..... 315/177, 315/276, 277, 279, 282, 283, 324, 312; 323/355–357; 307/17, 104, 109; 363/153; 345/102
See application file for complete search history.

(56) References Cited

U.S. PATENT DOCUMENTS 3,551,799 A * 12/1970 Koppelmann ..... 323/210
5,640,314 A * 6/1997 Glasband et al. ..... 363/36
7,250,731 B2 * 7/2007 Jin ..... 315/282
7,265,499 B2 * 9/2007 Ball ..... 315/282
7,282,868 B2 * 10/2007 Ushijima et al. ..... 315/277

FOREIGN PATENT DOCUMENTS

WO WO 2005-038828 4/2005

OTHER PUBLICATIONS

Shinmen, 2005, International Display Workshops.

* cited by examiner

*Primary Examiner*—Haissa Philogene
(74) *Attorney, Agent, or Firm*—Cooper & Dunham LLP

(57) ABSTRACT

The invention relates to a transformer (10) for balancing the current in an AC circuit, comprising a primary winding (12), a secondary winding (14) and a main inductance (16). The transformer is characterized in that a capacitive component is connected in parallel to the primary winding (12) or to the secondary winding (14), whose capacitance value is determined such that the reactive current $I_L$ brought about by the main inductance (16) is substantially compensated. A transformer of this kind can preferably be employed in current balancing circuits as used, for example, in systems for backlighting LCD displays.

17 Claims, 3 Drawing Sheets

TRANSFORMER FOR BALANCING CURRENTS

BACKGROUND OF THE INVENTION

The invention relates to a transformer for balancing currents, also referred to as a current balancing transformer.

Current balancing transformers are used for balancing alternating currents. The advantages of these passive components lie in their simplicity, since no active regulation is needed.

FIG. 1 shows a circuit diagram of a transformer 10 having a primary winding 12 and a secondary winding 14. In balancing the current, a transformer makes use of the fact that the ratio of the current $I_P$ in the primary winding and the current $I_S$ in the secondary winding is the inverse of the ratio of the number of windings in the primary winding $N_P$ to the number of windings in the secondary winding $N_S$, as described in the equation below.

$$\frac{I_s}{I_p} = \frac{N_p}{N_s} \quad [1]$$

Thus where $N_P$ is equal to $N_S$, the current $I_S$ in the secondary winding also corresponds to the current $I_P$ in the primary winding. It is of course clear that if there is a difference in the winding ratio $N_P$, $N_S$ in the primary and secondary winding, a difference in the current ratio between the two windings may also be achieved.

A backlight is a necessary requirement for LCD displays in order to achieve a visible image, since LCD displays themselves do not emit light. For this kind of backlight, cold cathode fluorescent lamps (CCFLs) are generally employed, these lamps being supplied with a high-frequency AC voltage of some 1000 volts at a current of 5 to 6 milliamperes. However, since several lamps are employed in the backlight, it is necessary to control the brightness of the lamps, making it possible to achieve a uniform illumination of the LCD display. The brightness of the lamps is controlled in that each lamp is supplied with the same operating current. For this purpose, an appropriate device is needed to uniformly distribute the current over the number of lamps, current balancing transformers being preferably employed.

FIG. 2 shows a schematic circuit diagram of this kind of backlight device having current balancing transformers 10*a* and 10*b*. Each primary winding of the transformers 10*a* and 10*b* is coupled in series to two cold cathode fluorescent lamps 20*a* and 22*a* or 20*b* and 22*b* respectively and connected to a high voltage source 24. The secondary windings of the transformers 10*a* and 10*b* are interconnected in series to a closed circuit. In this secondary circuit, the same current $I_S$ flows through both secondary windings of the transformers 10*a* and 10*b*, so that the same current $I_P$ also flows in the primary circuit of the two transformers, assuming the transformers are identical. The current balancing circuit shown in FIG. 2 can also be extended to include more than two transformers. However, the quality of current balancing using this kind of circuit is often unsatisfactory. The reason for this is that the transformers have a main inductance that in practice also has to be taken into account and that partly gives rise to large tolerances between the individual currents of the transformers.

FIG. 3 shows a circuit diagram of a transformer 10 comprising a primary winding 12, a secondary winding 14 and a main inductance 16 as depicted. The main inductance 16 generates an additional current $I_L$ on the primary side of the transformer that is also referred to as magnetization current. Due to a relatively large tolerance in the main inductance dL/L between the transformers, this current $I_L$ can have a tolerance of 20% between the individual transformers 10*a*, 10*b*. Based on the series connection of the secondary windings the secondary current is equal in all transformers but the primary currents in the transformers and therefore, the lamp currents differ in the main inductances (16) due to the tolerance. The formula below describes the influence of the tolerance of the main inductance on the change in the primary current:

$$\frac{dI_p}{I_p} = \left(\frac{I_L}{I_p}\right)^2 \cdot \frac{dI_L}{I_L} = -\left(\frac{I_L}{I_p}\right)^2 \cdot \frac{dL}{L} \quad [2]$$

It can be seen that the smaller the magnetization current $I_L$ in relation to the primary current, the smaller is the change in the primary current $dI_S/I_S$. One way of achieving this is to make the main inductance sufficiently large by having, for example, a large number of windings of the primary or secondary windings respectively. In doing this, however, the size and power loss of the transformer is increased, along with manufacturing costs. WO 2005/038828, for example, suggests using a transformer having high permeability in order to reduce reactive current. However, cores having high relative permeability are again quite expensive.

SUMMARY OF THE INVENTION

The object of the invention is to provide a current balancing transformer that has lower tolerances between the primary and secondary current and in which the influence of the main inductance on the secondary current in particular is minimized.

This object has been achieved according to the invention by a transformer having the characteristics described. Preferred embodiments of the invention and other advantageous characteristics are described.

The invention proposes a capacitor connected in parallel to the primary winding or the secondary winding of the transformer, the capacitor being dimensioned such that the main inductance is substantially compensated.

The value of the capacitor is calculated from the reciprocal value of the main inductance of the transformer multiplied by the square of the angular frequency of the alternating current with which the transformer is supplied.

Depending on the current transfer ratio of the transformer, the primary winding and the secondary winding can have the same or a different number of windings.

The invention further applies to a current balancing circuit having a plurality of transformers according to the invention for the purpose of distributing a current over a plurality of loads connected in parallel with respect to each other that are supplied from a common AC current source. In a first embodiment of the current balancing transformer, the primary winding of each transformer is coupled in series to a load and connected to the AC current source, the secondary winding of the transformers being interconnected in series to a closed circuit.

The load consists of a lamp, preferably a cold cathode fluorescent lamp, but may also consist of two lamps connected in series, the associated winding of each transformer being connected in series between the two lamps. In order to distribute a current uniformly over several of these loads, provision is made for all transformers to have the same number of primary windings. Also, the secondary winding numbers of all transformers are equal. A current balancing circuit of this kind can be advantageously employed in a system for backlighting LCD displays.

BRIEF DESCRIPTION OF THE DRAWINGS

Embodiments of the invention are described in more detail below on the basis of the drawings. Further characteristics and advantages of the invention follow from this.

DESCRIPTION OF PREFERRED EMBODIMENTS OF THE INVENTION

Figure 1:
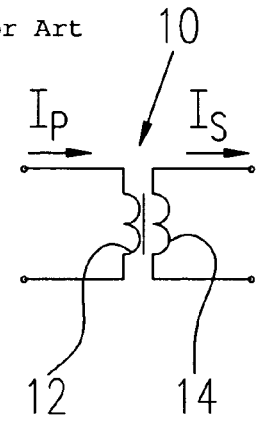
Fig. 1 Prior Art
FIG. 1 shows a circuit diagram of a conventional transformer
Figure 2:
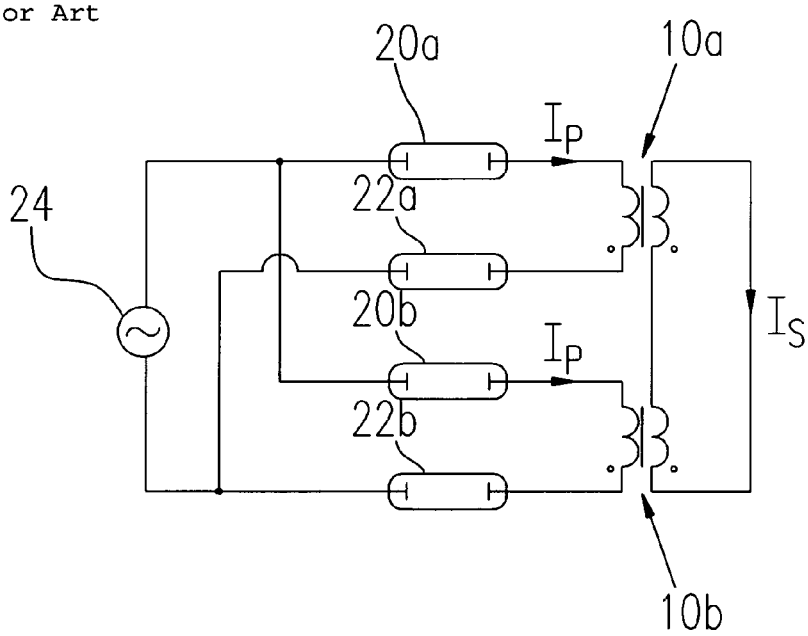
Fig. 2 Prior Art
FIG. 2 shows a schematic circuit diagram of a current balancing circuit to distribute a current between a plurality of lamps.
Figure 3:
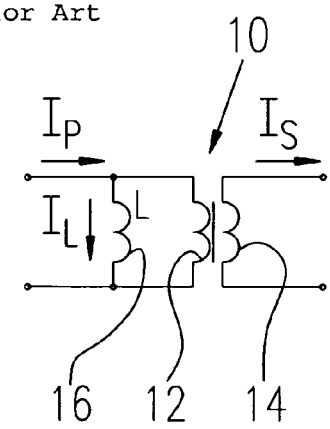
Fig. 3 Prior Art
FIG. 3 shows the circuit diagram of the transformer according to FIG. 1 depicting the main inductance.

FIGS. 1 to 3 have already been described in detail in the introductory section of the description. Please refer to the relevant passages in the text.

Figure 4:
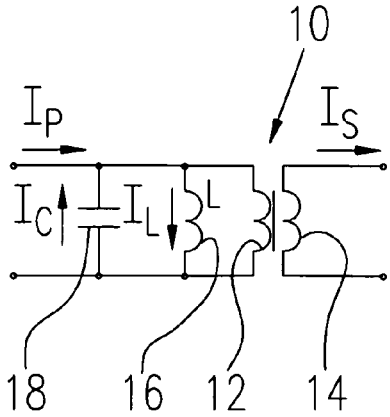
FIG. 4 shows the transformer according to FIG. 3 having a capacitor according to the invention to compensate the main inductance.

FIG. 4 shows a modified transformer 10 according to the invention comprising a primary winding 12, a secondary winding 14 and the main inductance 16. According to the invention, a capacitor is connected in parallel to the main inductance 16, i.e. to the primary winding 12, the capacitor giving rise to a reactive current $I_C$ that flows in an opposite direction to the reactive current $I_L$ of the main inductance. In this case, the capacitor, together with the main inductance of the transformer, forms a high-impedance network that operates in or almost at parallel resonance. The capacitance of the capacitor must be so dimensioned that the reactive current $I_C$ equals the reactive current $I_L$ at the relevant operating frequency of the transformer. By these means, the overall reactive current can be considerably reduced, typically to the value of the inductance tolerance (20%). Consequently, the reactive current can be reduced to one fifth. By rearrangement of equation [2] it can be recognized that the tolerance of the primary currents is also reduced to one fifth by this.

$$\frac{dI_p}{I_p} = \left(\frac{I_L}{I_p}\right)^2 \cdot \frac{dI_L}{I_L} = \frac{I_L}{I_p} \cdot \frac{dI_L}{I_p} \qquad [2a]$$

Capacitance is calculated as described below using the equation for parallel resonance:

$$C = \frac{1}{L \cdot (2 \cdot \pi \cdot f_{op})^2} \qquad [3]$$

Here, L is the main impedance of the transformer (on the capacitor side), $f_{op}$ the operating frequency of the transformer.

Figure 5:
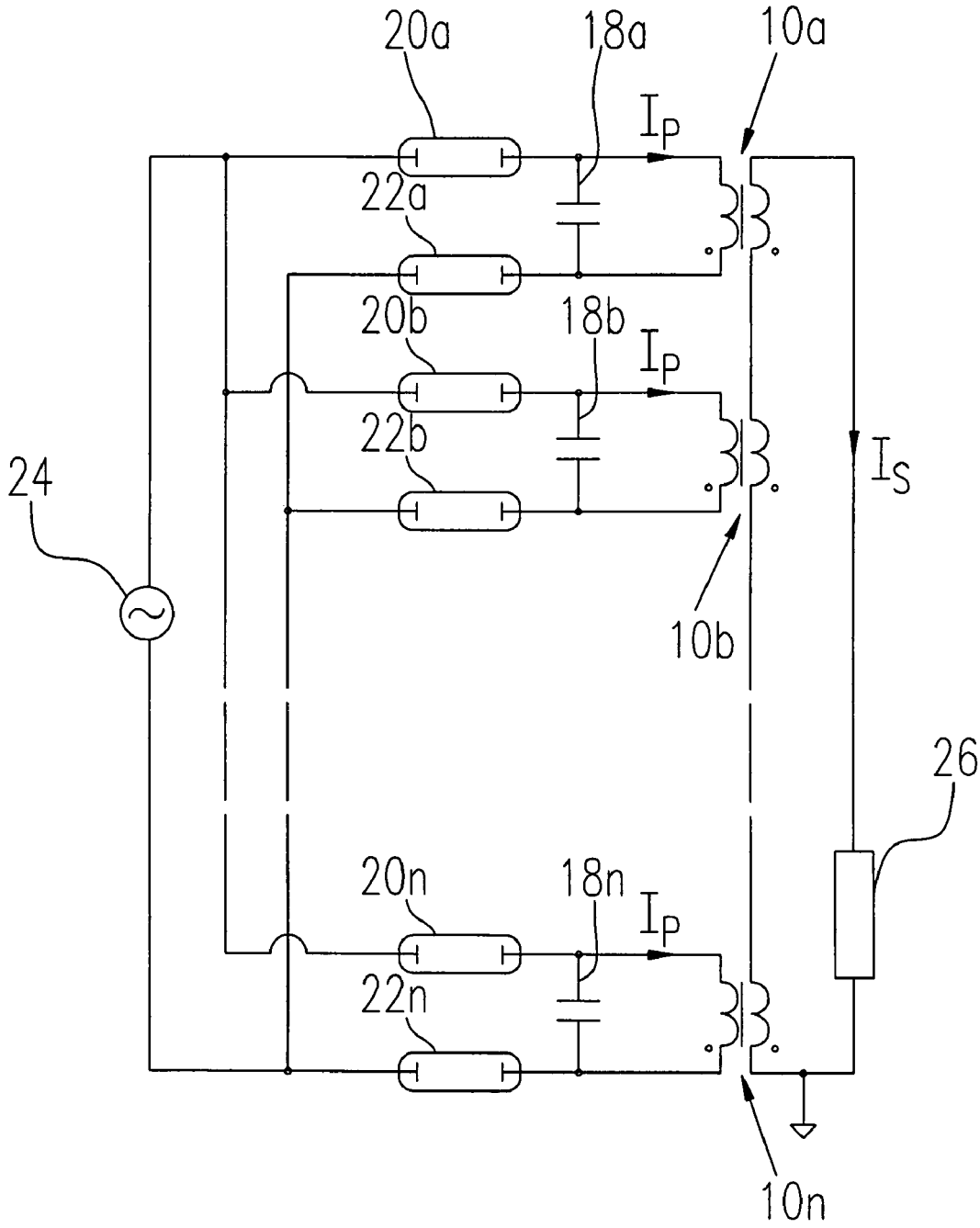
FIG. 5 shows an embodiment of a current balancing circuit having the modified transformers according to the invention, wherein the capacitor is connected in parallel to the primary winding.

FIG. 5 shows a circuit for balancing the current that is similar to the circuit in FIG. 2 comprising a plurality of balancing transformers 10*a*, 10*b*, . . . , 10*n*, which distribute the current of a high voltage source 24 uniformly over a plurality of lamps 20*a*, 22*a*, 20*b*, 22*b*, . . . , 20*n*, 22*n*. According to the invention, appropriate balancing capacitors 18*a*, 18*b*, . . . , 18*n* that compensate the influence of the primary inductance in the transformers 10*a*, 10*b*, . . . , 10*n* are connected in parallel to the primary windings of the transformers 10*a*, 10*b*, . . . , 10*n*. In the secondary circuit that is formed by the secondary windings of the transformers 10*a*, 10*b* and 10*n* connected in series, a precision resistor 26 can be provided whose voltage drop may be used to measure the current in the secondary circuit. This can be used, for example, to detect the failure of a lamp since the current in the secondary circuit would be altered by such a failure.

Figure 6:
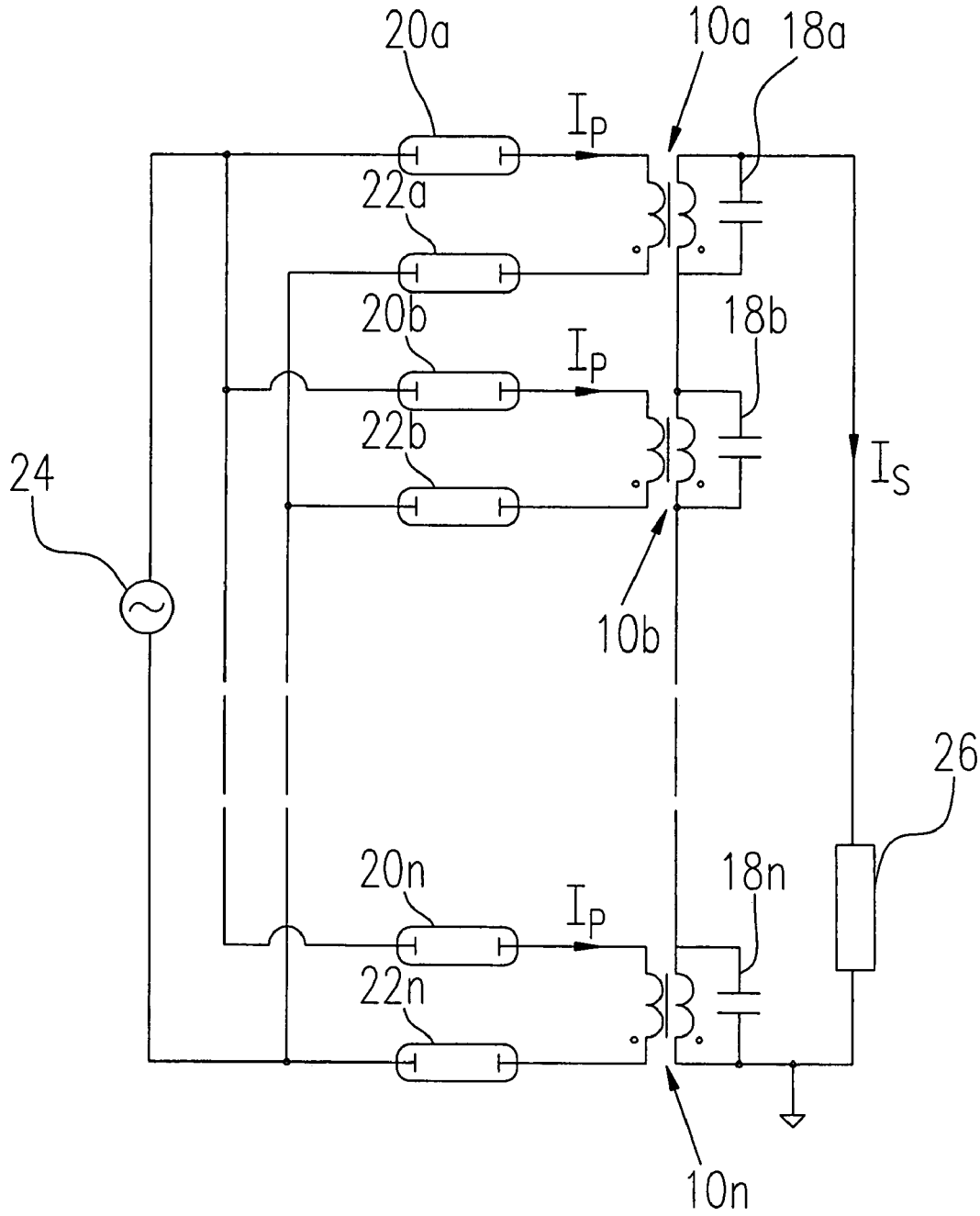
FIG. 6 shows an embodiment of a current balancing circuit having the modified transformers according to the invention, wherein the capacitors are connected in parallel to the secondary winding.

FIG. 6 shows an embodiment of a current balancing circuit to distribute a current between a plurality of lamps 20*a*, 22*a*, 20*b*, 22*b*, . . . , 20*n*, 22*n* that is modified with respect to FIG. 5. In contrast to the circuit according to FIG. 5, here the capacitors 18*a*, 18*b*, . . . , 18*n* are connected on the secondary side of the transformers in parallel to the secondary windings. In principle, it is of no consequence to the invention whether the balancing capacitor is provided on the primary side or on the secondary side of the transformer. Employing the capacitors on the secondary side of the transformers can, however, be advantageous if different numbers of windings are used for the primary windings and the secondary windings. If the number of windings in the secondary windings are made less than the number of primary windings, the transfer rate and the voltage on the secondary windings is also reduced. This makes it possible to use capacitors having lower electric strength. However, the necessary capacitance value then increases with the square of the transfer rate of the transformer. Depending on the application, optimum pricing between a larger capacitance value and lower electric strength of the capacitors has to be determined.

| Identifaction Reference List | |
|---|---|
| 10 | Transformer (10a, 10b, . . . , 10n) |
| 12 | Primary winding |
| 14 | Secondary winding |
| 16 | Main inductance |
| 18 | Capacitor (primary capacitance) |
| 20 | Lamp (20a, 20b, . . . , 20n) |
| 22 | Lamp (22a, 22b, . . . , 22n) |
| 24 | AC voltage source |
| 26 | Precision resistor |

The invention claimed is:

1. A transformer (10) for balancing the current in an alternating current circuit comprising a primary winding (12), a secondary winding (14) and a main inductance (16), characterized by a capacitive component (18) connected in parallel to the primary winding (12) or to the secondary winding (14), whose capacitance value is determined such that the reactive current $I_L$ brought into being by the main inductance (16) is substantially compensated.

2. A transformer according to claim 1, characterized in that the capacitance value of the component (18) is calculated from the reciprocal value of the value L of the main inductance (16) multiplied by the square of the angular frequency of the alternating current.

3. A transformer according to claim 1, characterized in that the primary winding (12) and the secondary winding (14) have the same number of windings.

4. A transformer according to claim 1, characterized in that the primary winding (12) and the secondary winding (14) have a different number of windings.

5. A transformer according to claim 1, characterized in that it is a high-voltage transformer.

6. A current balancing circuit having a plurality of transformers (10*a*, 10*b*, . . . , 10*n*) according to claim 1 for the purpose of distributing a current over a plurality of loads (20*a*, 22*a*; 20*b*, 22*b*; . . . ; 20*n*, 22*n*) connected in parallel with respect to one another that are supplied by a common AC current source (24), wherein the primary winding of each transformer (10*a*, 10*b*, . . . , 10*n*), each coupled in series to a load, is connected to the AC current source (24), and the secondary windings of the transformers are interconnected in series to a closed secondary circuit.

7. A current balancing circuit having a plurality of transformers (10*a*, 10*b*, . . . , 10*n*) according to claim 1 for the purpose of distributing a current over a plurality of loads (20*a*, 22*a*; 20*b*, 22*b*; . . . ; 20*n*, 22*n*), connected in parallel with respect to one another that are supplied by a common AC current source (24), wherein the primary windings of the transformers coupled in series are connected to the AC current source (24) and a load (20*a*, 22*a*; 20*b*, 22*b*; . . . ; 20*n*, 22*n*) is connected to each secondary winding of each transformer.

8. A transformer according to claim 6, characterized in that the load (20*a*, 22*a*; 20*b*, 22*b*; . . . ; 20*n*, 22*n*) consists of a lamp.

9. A transformer according to claim 6, characterized in that the load (20*a*, 22*a*; 20*b*, 22*b*; . . . ; 20*n*, 22*n*) consists of two lamps connected in series, and the winding of each transformer (10*a*, 10*b*, . . . , 10*n*) associated with the lamps is connected in series between the two lamps.

10. A transformer according to claim 8, characterized in that the lamps (20*a*, 22*a*; 20*b*, 22*b*; . . . ; 20*n*, 22*n*) are cold cathode fluorescent lamps.

11. A transformer according to claim 6, characterized in that all transformers (10*a*, 10*b*, . . . , 10*n*) have the same number of primary windings and secondary windings.

12. The application of a current balancing circuit according to claim 6 in a system for backlighting LCD displays.

13. A transformer according to claim 7, characterized in that the load (20*a*, 22*a*; 20*b*, 22*b*; . . . ; 20*n*, 22*n*) consists of a lamp.

14. A transformer according to claim 7, characterized in that the load (20*a*, 22*a*; 20*b*, 22*b*; . . . ; 20*n*, 22*n*) consists of two lamps connected in series, and the winding of each transformer (10*a*, 10*b*, . . . , 10*n*) associated with the lamps is connected in series between the two lamps.

15. A transformer according to claim 13, characterized in that the lamps (20*a*, 22*a*; 20*b*, 22*b*; . . . ; 20*n*, 22*n*) are cold cathode fluorescent lamps.

16. A transformer according to claim 7, characterized in that all transformers (10*a*, 10*b*, . . . , 10*n*) have the same number of primary windings and secondary windings.

17. The application of a current balancing circuit according to claim 7, in a system for backlighting LCD displays.

* * * * *